United States Patent [19]

Lyng

[11] Patent Number: 4,573,722

[45] Date of Patent: Mar. 4, 1986

[54] LOCKER HANDLE ASSEMBLY

[76] Inventor: William E. Lyng, Main St., Truthville, N.Y. 12854

[21] Appl. No.: 664,615

[22] Filed: Oct. 25, 1984

Related U.S. Application Data

[63] Continuation of Ser. No. 542,001, Oct. 14, 1983, abandoned.

[51] Int. Cl.[4] ..... E05C 1/04

[52] U.S. Cl. ..... 292/148; 292/DIG. 68

[58] Field of Search ..... 292/148, 145, 137, 147, 292/152, 336.3, DIG. 31, DIG. 68

[56] References Cited

U.S. PATENT DOCUMENTS

| | | | |
|---|---|---|---|
| 1,724,116 | 8/1929 | Swearengin | 292/145 X |
| 2,912,271 | 11/1959 | Schaefer | 292/336.3 |
| 3,158,908 | 12/1964 | Springer | 292/DIG. 30 |
| 3,866,961 | 2/1975 | List | 292/148 X |

FOREIGN PATENT DOCUMENTS

| | | | |
|---|---|---|---|
| 1463128 | 11/1966 | France | 292/148 |

*Primary Examiner*—Richard E. Moore

*Attorney, Agent, or Firm*—Heslin, Watts & Rothenberg

[57] ABSTRACT

A locker handle assembly has a recessed mounting receptacle with a slide bolt mounted thereon for horizontal reciprocal movement. The slide bolt employs a double bar construction and includes a front bar, to which an operating handle may be attached, and a back bar. The front and back bars are held together at opposite ends and in a spaced-apart relationship such that the front bar passes through longitudinally extending slots in the mounting receptacle and the back bar passes behind a rear wall of the receptacle. The slide bolt may be secured in a latched position by a lock cooperating with lock engaging means attached to the slide bolt.

10 Claims, 3 Drawing Figures

Fig. 1
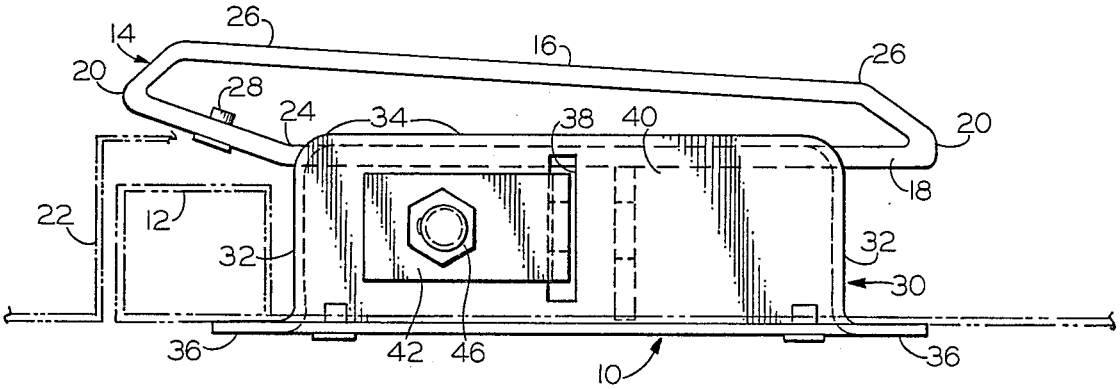
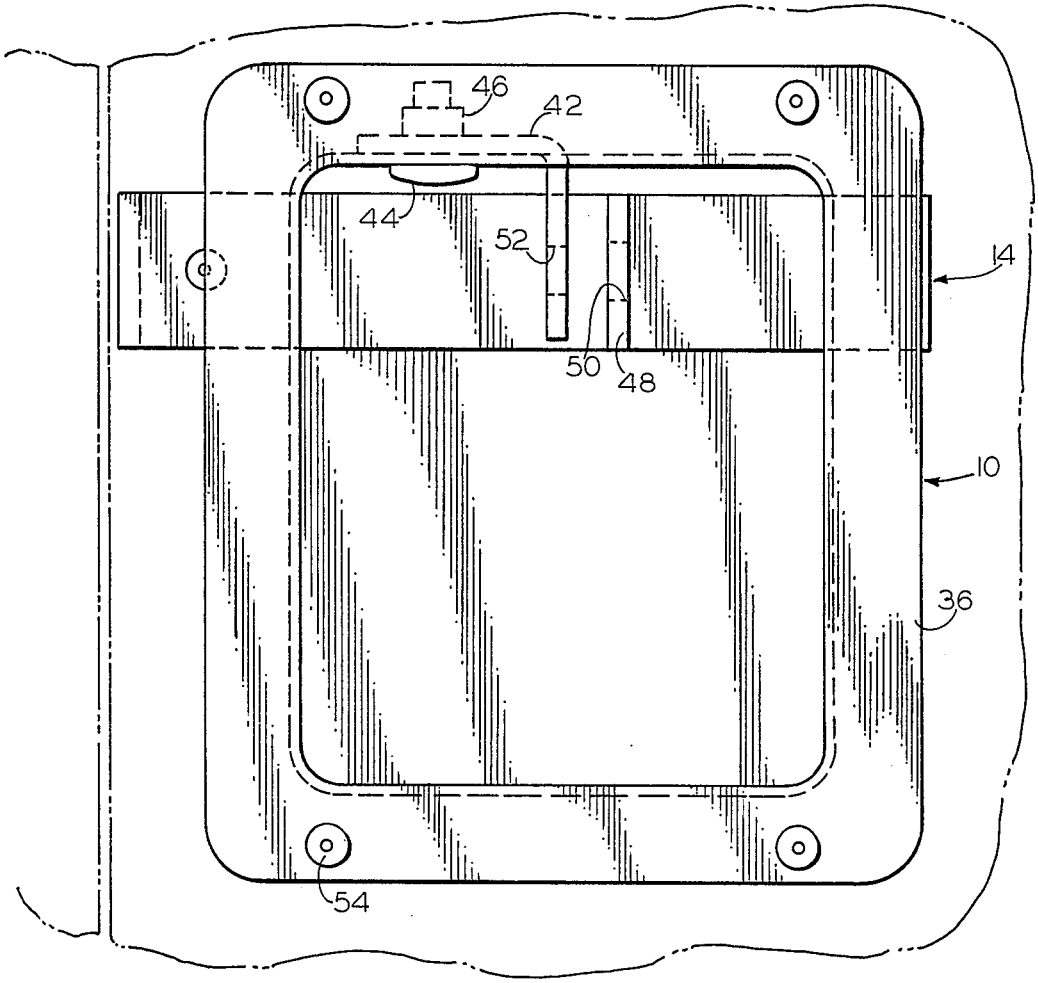
Fig. 2

LOCKER HANDLE ASSEMBLY

This application is a continuation of 06/542,001, filed 10/14/83, now abandoned.

FIELD OF THE INVENTION

This invention relates to a locker handle assembly generally used in wardrobe type lockers.

BACKGROUND AND SUMMARY OF THE INVENTION

Wardrobe lockers are installed in virtually every public and private school facility and in a variety of other locations such as train stations, bus depots and airports. The preferred locking system, especially in school facilities, is one that can be used with combination locks. Traditionally, the most commonly installed system has utilized a three point latching gravity bar. This is the type of a latching system having a long vertical internal locking member in the locker door which one operates by lifting an external handle which is attached to the locking member. Upon release of the handle, the locking member returns by gravity to its locking position. Typically, the locking member engages hook-shaped hardware mounted at three places on the door jamb. These latching systems are usually fabricated of a thin molded metal that cannot withstand years of continued abuse in today's school systems. Experience has indicated that the latch system is expensive to maintain because of the repair frequency. Manufacturers of the latch system are constantly changing their designs in an attempt to improve the performance of the locking mechanism and decrease the cost of repair and maintenance. Consequently, replacement parts are no longer available for some of the older models and the schools are faced with replacement of the entire latching system. In spite of determined efforts by locksmiths and locker manufacturers to provide a better locking handle system, the three point gravity latch remains the currently available standard.

In addition to maintenance and repair difficulties, the three point latch system does not provide adequate safeguards against vandalism. The adept and determined student can, without much difficulty, gain access to any locker by using a simple jimmying process.

I have discovered that the shortcomings of the prior art can be overcome by designing a new locker handle assembly. I have found that, if the three point gravity latch system is replaced by a one point slide bolt assembly, the maintenance and repair costs can be reduced significantly. Furthermore, the simplicity of my new design accompanied with the use of heavy duty materials provides a system that offers increased protection against vandalism. My invention is economical to produce and can be used in both new products and in repair programs to replace the more traditional latching systems. This new assembly requires no modification of design or special construction of the locker doors or of the locker frame. Installation is easily accomplished by cutting an opening of an appropriate size in the locker door. Once installed, the overall appearance of the locker door is improved because the recessed assembly results in a smooth, flush front.

More specifically, the locker handle assembly uses a recessed mounting receptacle, generally of a square or rectangular shape, that can be set into a locker door. A flange extends around the open end permitting the receptacle to be riveted securely to the locker door. Longitudinally extending slots are located on each of two opposite sides of the receptacle. A double slide bolt having two separate bars welded together at opposite ends and held apart sufficiently so that the front bar can pass through the longitudinal slots in front of the receptacle, while the back bar moves freely back and forth behind the receptacle. This type of double truss construction is much stronger than that using a single slide bolt. The length of the slide bolt is such that a predetermined portion of the slide bolt will extend beyond the receptacle to behind the locker door jamb when the slide bolt is located in its latched position. The slide bolt is provided with a handle that is welded perpendicularly to the front bar. The handle has a first lock receiving aperture which when aligned with a second lock receiving aperture of an L-shaped member attached to the receptacle, allows the entire assembly to be locked in a latched position by the insertion of a padlock through the aligned apertures. When the padlock is removed, the handle is used to guide the slide bolt into its unlatched position. Also, the handle extends outwardly enough so that it can be grasped in order to pull the locker door open.

One of the major objectives of this invention is to provide a locker handle assembly having a single latching system in order to reduce the maintenance and frequency of repair required by the prior art units.

Another objective is to provide a heavy duty locker handle that will effectively deter vandalism.

It is yet another objective of this invention to produce a locker handle assembly that can be used to replace the worn out or damaged traditional locker handles without having to replace the entire locker itself.

It is a further object of this invention to provide a locker assembly that is completely recessed to give a modern flush front appearance to the old lockers.

And finally, a further object of the invention is to provide a new assembly that would overcome the difficulties of the prior art and also be economical to produce.

BRIEF DESCRIPTION OF THE DRAWINGS

FIG. 1 is a top plan view of the recessed locker handle assembly.

FIG. 2 is a front elevational view of the assembly.

DETAILED DESCRIPTION OF THE DRAWINGS

Figure 3:
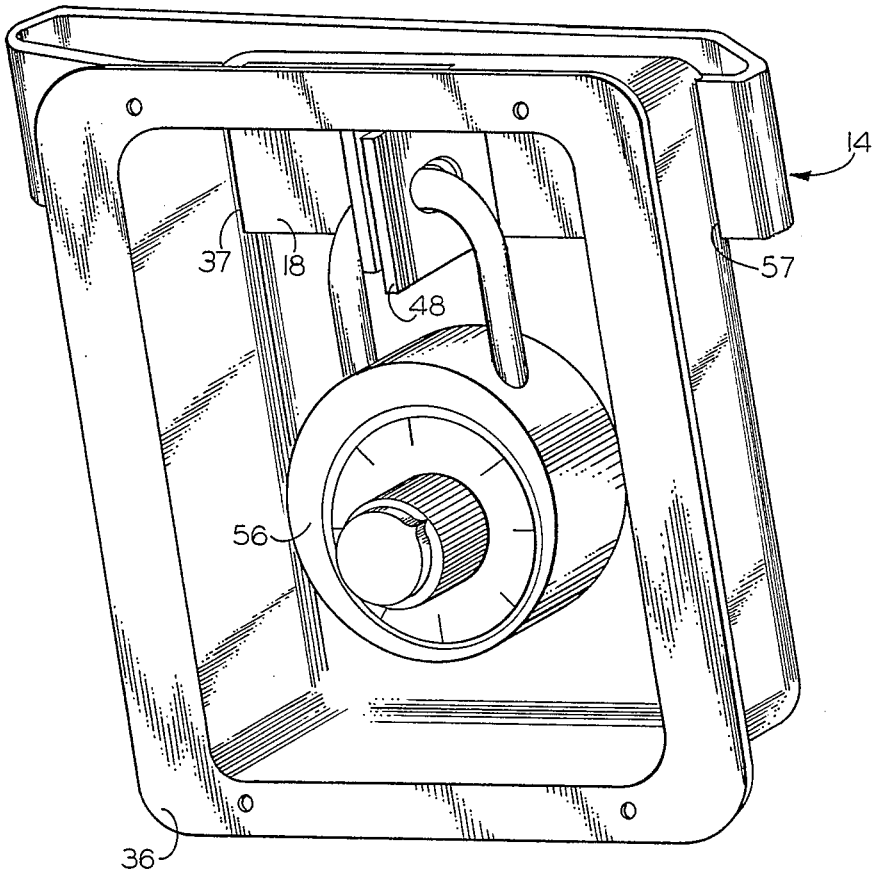
FIG. 3 is a perspective view from the right front side showing the assembly in its latched locked position.

Referring now in detail to the drawings, FIGS. 1 and 2 show a top plan view and a front elevational view, respectively, of locker handle assembly 10 mounted in locker door 12 (shown in phantom) that opens from the left. Locker door 12 is in its closed position and slide bolt 14 is shown approximately halfway between its latched and unlatched position. FIG. 1 demonstrates the double bar construction used for slide bolt 14 that contributes significantly to the overall strength of this particular system. Slide bolt 14 consists of two rectangular bars, back bar 16 and front bar 18, welded together at opposite ends 20. The length of slide bolt 14 depends upon the particular locker unit for which the assembly is constructed. It is important that slide bolt 14 be capable of extending a sufficient distance behind locker frame 22. FIG. 1 also demonstrates the asymmetry of back bar 16 and front bar 18. The distance between back bar 16 and front bar 18 is also determined by the particular locker unit for which the locker handle assembly is designed. Front bar angle 24 can be greater or lesser than that shown in FIG. 1., depending on the thickness of locker frame 22. Consequently, back bar angles 26 will vary according to front bar angle 24. Both front and back bar angles must at all times be sufficient to permit slide bolt 14 to move freely in a reciprocal fashion between a latched and unlatched position. Stop 28 is placed on front bar 18 in order to prevent welded end 20 of slide bolt 14 from constantly striking the recessed mounting receptacle 30. Without stop 28 continued impacting of welded end 20 would result in a weakening of slide bolt 16. Slide bolt 16 is most conveniently made of heavy duty rolled steel and coated with corrosion resistant nickel.

Still referring to FIGS. 1 and 2, receptacle 30 is recessed to a depth that will fit into most standard lockers. Receptacle 30 is molded using one continuous sheet of drawn metal, generally about 18 gauge, to form outwardly extending side walls 32, rear wall 34 and flange 36. A longitudinal slot is cut into each of two opposite walls of receptacle 30 so that front bar 18 may slide back and forth across rear wall 34. Longitudinal slots 37 and 57 and slide bolt 14 (see FIG. 3) have corresponding dimensions that permit this reciprocal movement to be carried out smoothly. Lateral slot 38 extending outwardly is cut into top wall 40 in order to accommodate L-shaped member 42. Securing the L-shaped member 42 to receptacle 30 is best accomplished by drilling a single hole through L-shaped member 42 and top side wall 40 of receptacle 30, inserting bolt 44 up through both receptacle 30 and L-shaped member 42 and fastening with nut 46. A spanner bolt with a tapered shank has proven most useful for this attachment, but those skilled in the art will understand that other types of bolts may be used.

Referring now to FIG. 2, it can be seen that L-shaped member 42 extends through lateral slot 38 and depends downward into the recessed cavity defined by receptacle 30. Handle 48 constructed of the same rolled steel as slide bolt 14, is welded perpendicularly to front bar 18. Handle 48 contains a first lock receiving aperture 50 that is aligned with and slightly larger than a second lock receiving aperture 52 in depending member 42 (the importance of relative aperture size will be discussed in more detail in the next paragraph). Receptacle 30 is attached to locker door 12 by the placement of rivets 54 through a plurality of openings drilled into flange 36.

Finally, in reference to FIG. 3, locker handle assembly 10 is shown in its latched position with combination lock 56 securely in place. It can be appreciated from this figure that the smaller size of the second lock receiving aperture 52 prevents combination lock 56 from being tilted sideways and then angled upward in order to allow slide bolt 14 to move towards its unlatched position without having removed combination lock 56. The flush streamline look of locker handle assembly 10 can also be appreciated in FIG. 3. There are no protruding parts and even padlock combination lock 56 fits completely within recessed mounting receptacle 30.

An alternate embodiment, not shown in the figures, has been designed to accommodate the use of built-in combination and flat key units in place of padlock combination lock 56. This embodiment utilizes the same basic construction as discussed above except for minor modifications. First, the locking mechanisms of both the built-in combination and flat key units are located behind rear wall 34. Therefore, this requires the placement of the proper opening in rear wall 34 so that these units can be properly mounted therethrough. Second, because there is no padlock, L-shaped member 42 and its corresponding lateral slot 38 are no longer required. Handle 48 still functions as a means for guiding slide bolt 14 between its latched and unlatched position and for pulling the locker door open, but it no longer secures slide bolt 14 in its latched position. This is now performed behind rear wall 34 by the placement of a metal latch or bar on back bar 16 of slide bolt 14 that is engaged by the built-in units in order to secure slide bolt 14 in its latched position.

It is to be understood that the invention is not to be limited to the specifics of the embodiments which have been shown and described, but is instead to be defined only by the appended claim.

I claim:

1. A locker handle assembly comprising:

a recessed mounting receptacle having a rear wall, outwardly extending side walls, an open front portion, and a flange extending from said side walls at the open front portion;

two longitudinally extending slots, one each located along each of two opposite sides of the receptacle; and a slide bolt having front and back bars held together at opposite ends and in a spaced-apart relationship such that the front bar passes through the longitudinally extending slots in front of the rear wall and the back bar passes behind the rear wall, the slide bolt being horizontally reciprocally operable between a latched and unlatched position such that a predetermined portion of the slide bolt moves in a reciprocal fashion behind a locker door frame.

2. The locker handle assembly of claim 1, further comprising lock engaging means attached to said slide bolt.

3. The locker handle assembly of claim 2, in combination with a lock located at least partially within the receptacle whereby said lock and said lock engaging means serve to secure the slide bolt in the latched position.

4. The locker handle assembly of claim 2, wherein the lock engaging means comprises a handle secured to and positioned substantially perpendicular to the front bar of the slide bolt, said handle extending outwardly and having a first lock receiving aperture; and wherein said locker handle assembly further comprises a depending member secured to the receptacle, said depending member having a second lock receiving aperture in substantial alignment with the first lock receiving aperture.

5. The locker handle assembly of claim 4 in combination with a padlock capable of passing through the first and second lock receiving apertures to secure the slide bolt in the latched position.

6. The locker handle assembly of claim 4 wherein a top side of the receptacle is provided with a laterally inwardly extending slot; wherein the depending member affixed to the receptacle comprises an L-shaped member extending across the top side of the receptacle and downward through the laterally inwardly extending slot; wherein said second lock receiving aperture is slightly smaller than the first lock receiving aperture; and wherein said locker handle assembly further comprises means for securing the L-shaped member to the receptacle.

7. The locker handle assembly of claim 2, further comprising means for attaching the flange of the receptacle to a locker door.

8. The invention of claim 7, wherein the flange is provided with a plurality of holes therethrough and wherein the means for attaching the flange to the locker door comprises securing means extending through said flange holes.

9. The invention of claim 2, in further combination with stop means between the slide bolt and the receptacle for limiting the movement of the slide bolt past its unlatched position.

10. The invention of claim 9, wherein the front and back bars of the slide bolt are rectangular in shape.

* * * * *